US007311231B2

(12) United States Patent
Noell et al.

(10) Patent No.: US 7,311,231 B2
(45) Date of Patent: Dec. 25, 2007

(54) DISPOSABLE POUCH HYDRATION SYSTEM

(75) Inventors: Micheal M. Noell, Virginia Beach, VA (US); Jeff Skillern, Boise, ID (US)

(73) Assignee: Blackhawk Industries Product Group Unlimited LLC, Norfolk, VA (US)

( * ) Notice: Subject to any disclaimer, the term of this patent is extended or adjusted under 35 U.S.C. 154(b) by 402 days.

(21) Appl. No.: 10/821,574

(22) Filed: Apr. 9, 2004

(65) Prior Publication Data

US 2004/0238571 A1 Dec. 2, 2004

Related U.S. Application Data

(63) Continuation-in-part of application No. 10/768,397, filed on Jan. 29, 2004, which is a continuation of application No. 10/085,626, filed on Feb. 26, 2002, now Pat. No. 6,722,533.

(51) Int. Cl.
*A45F 3/16* (2006.01)

(52) U.S. Cl. ..... 224/148.2; 220/705; 220/710; 220/714; 251/149.5; 215/388

(58) Field of Classification Search ..... 222/146.6, 222/175, 529; 251/149.6; 141/349; 215/388; 220/705, 710
See application file for complete search history.

(56) References Cited

U.S. PATENT DOCUMENTS 4,375,864 A * 3/1983 Savage ..... 222/105
4,420,097 A 12/1983 Motsenbocker
4,948,023 A 8/1990 Tripp
4,981,022 A * 1/1991 Snyder ..... 62/457.3
5,052,725 A * 10/1991 Meyer et al. ..... 285/308
5,060,833 A 10/1991 Edison et al.
5,085,349 A 2/1992 Fawcett
5,282,557 A 2/1994 McCook
5,427,290 A 6/1995 Thatcher
5,607,087 A 3/1997 Wery et al.
5,727,714 A 3/1998 Fawcett
5,772,573 A 6/1998 Hao
5,806,726 A 9/1998 Ho
5,864,880 A 2/1999 Adam
6,032,831 A 3/2000 Gardner et al.
6,039,305 A 3/2000 Hoskins et al.

* cited by examiner

*Primary Examiner*—Philippe Derakshani
(74) *Attorney, Agent, or Firm*—Bowman Green Hampton & Kelly, PLLC

(57) ABSTRACT

A hydration pouch with a releasable coupling is disclosed. In one embodiment, the hydration pouch is a flexible bag or pouch with a separate inlet and outlet. A hose or tube is provided for a user to draw refreshment from the pouch. A bite valve is provided at one end of the tube to be actuated by a user's teeth. A coupling is provided for attaching and detaching at least a portion of the hose at an opposite end of the hose. The coupling includes a shutoff or check valve that maintains the patency of the pouch when the hose is disconnected. In an alternative embodiment prefilled, disposable hydration pouches are removably coupled to the hose and then disposed and replaced following consumption of the liquid contained therein.

13 Claims, 13 Drawing Sheets

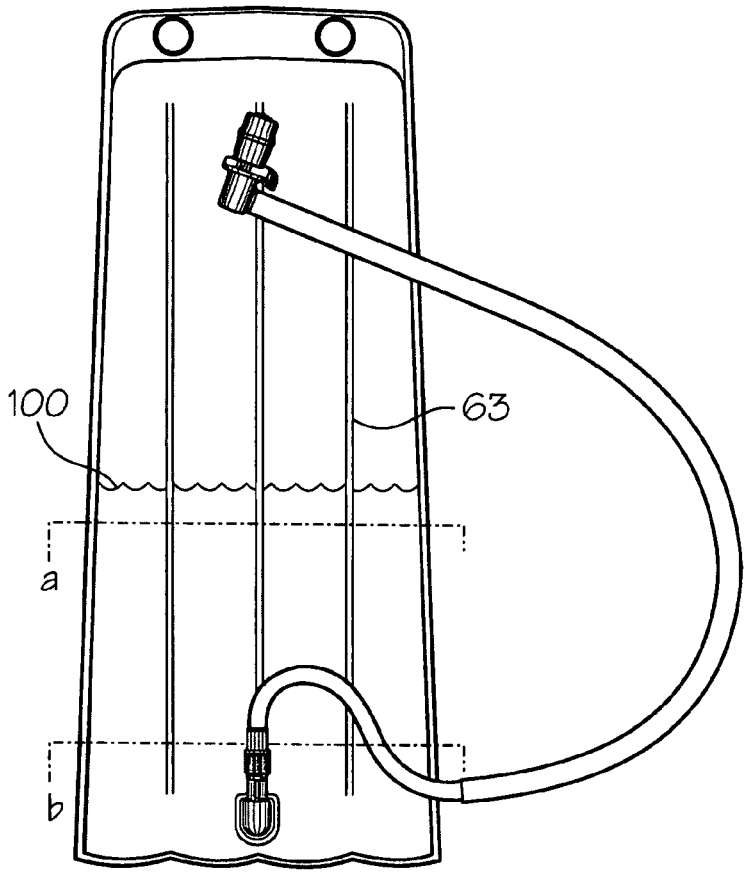
Fig. 7A
Fig. 7B
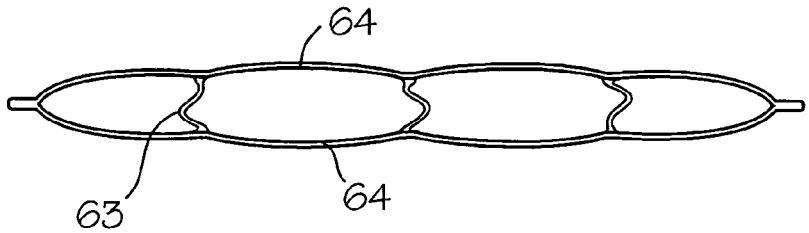
Fig. 7C
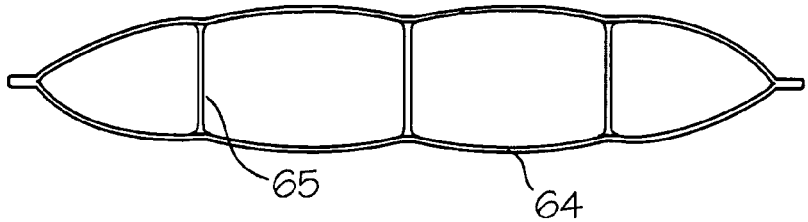

DISPOSABLE POUCH HYDRATION SYSTEM

This application is a continuation-in-part of U.S. patent application Ser. No. 10/768,397 filed on Jan. 29, 2004, which is a continuation of U.S. patent application Ser. No. 10/085,626 filed on Feb. 26, 2002, now U.S. Pat. No. 6,722,533 and claims priority therefrom.

The application did not receive federal research and development funding.

FIELD OF THE INVENTION

This invention relates to hydration systems, particularly passive hydration bladder type systems that find use in cycling and other out-door activity such as hiking, skiing or hunting.

BACKGROUND OF THE INVENTION

Numerous hydration systems have been conceived in effort to effectively and conveniently quench the thirst of cyclist and other athletes or hobbyist who need to pack or carry along a personal water supply. Many have chosen to abandon the trusty water bottle mounted in a cages attached to a bicycle frame or carried in a hip pack in favor of using a hydration pouch.

A popular class of hydration pouch products set a pouch in a backpack, whereby access to the liquid contents of the pouch are made available by a hose running from the base of the pouch to the mouth of a user. A bite valve is usually included at the end of the hose so the user can obtain refreshment without involving his or her hands. Examples of such systems are disclosed in U.S. Pat. Nos. 4,420,097; 4,948,023; 5,085,349; 5,060,833; 5,282,557; 5,427,290; 5,727,714; 5,722,573; 5,806,726; 5,864,880[MSOffice1]; 6,032,831 and 6,039,305.

Hydration pouches have gained acceptance for reason of the large volume of drinking fluid they may contain—as compared to a standard, or even oversized cycling water bottle. Of equal importance, however, is the manner in which hydration pouches carry the drinking fluid. Its flexible nature allows the load carried on the user's back to conform in shape and also for the pouch to collapse as the liquid volume is drained from it. Both these feature contribute to the comfort of its use.

In contrast, water bottles as used in cycling are substantially rigid. They may be compressed to squeeze out their contents, however, they return to shape. Most often, such bottles are generally cylindrical, as is convenient for their receipt within a common water bottle cage.

A hydration system with some features in common with those of the present invention is disclosed in U.S. Pat. No. 5,607,087 to Wery, et al. Here, a pressurized water bottle connected to a hose with a bite valve is disclosed. At the end of the hose opposite the bite valve, a quick-connect/disconnect coupling is provided. When disengaged, the portion remaining with the water bottle, which includes a check valve or shut-off valve prevents the escape of fluid and pressurized gas there from.

The system in the Wery, et al. patent requires charging of a water bottle with pressurized gas in order to force fluid from an elevation below the bite valve to the mouth of the user. The valve combination disclosed facilitates trading out one spent bottle for another for providing continued refreshment to the user.

A primary distinction between the Wery, et al. system and that of the present invention is that the present invention employs a flexible hydration pouch. It eschews the rigidity of the water bottle (which is made even more so in the device in the referenced patent due to the presence of pressurized gas therein) in favor of the compliant advantages offered by a "Camel Bak®" type device.

While certain of such hydration pouch devices include removable hoses, none known of include a detachable hose with a check valve set to maintain the contents of the pouch upon removal of the hose. U.S. Pat. No. 5,803,726 to Ho merely discloses a hydration pouch with a hose that is attached (or may be removed) by way of a threaded coupling to the bag. Such a system does not allow for the advantages of the present invention as summarized below. Namely, Ho fails to disclose or suggest a hydration bladder that includes a valve that is biased shut when a hose for supplying fluid from the pouch to the user is disconnected from the pouch.

SUMMARY OF THE INVENTION

The present invention comprises a flexible hydration pouch, a hose or line attached thereto including a valve for actuation by a user to access fluid and a coupling member attaching the hose to the pouch, wherein the coupling member includes a shut-off or check valve holding fluid within the pouch when the hose is disconnected. Another valve may also be provided to hold fluid in the hose when portions of the coupling are disengaged. A portion of the coupling may be provided integrally with the pouch. Alternately, the coupling may be provided in-line with the hose.

Such a system offers the ability to decouple a hose from a hydration bladder and leave it engaged with a backpack as typically used in connection with hydration pouches. The decoupled hydration pouch then may be refilled, chilled or otherwise attended to. Filling of the bag is feasible in view of the shutoff valve provided to maintain the contents of the pouch without the closure typically offered by a hose with a bite valve. Especially in connection with the ability to easily connect a heated or refrigerated pouch with a hose set in a pack, it is preferred to use a hydration pouch that integrally includes a thermal medium. In addition, the coupling/check-valve combination disclosed offers a potential for certain modularity. It allows a user to purchase only one hose and bite valve for use with any number of hydration pouches that may vary is size or features—such as integral cooling medium.

In one preferred embodiment the present invention is directed to a hydration system, which includes a flexible pouch having fluid therein, the pouch having an outlet for passing fluid from the pouch and including a check valve, a hydration tube having two ends and removably coupled at one end to the outlet, and a user actuated valve connected at one end of the hydration tube distal from the outlet, wherein the check valve is open to allow fluid to flow from the flexible pouch when the hydration tube is coupled to the flexible pouch and the check valve is closed to prevent fluid from flowing from the flexible pouch when the hydration tube is decoupled from the flexible pouch.

In another embodiment the present invention is directed to a hydration system which includes a supply of prefilled, flexible pouches having fluid therein, each of the pouches having an outlet for passing fluid from the pouch and including a check valve, a hydration tube having two ends and removably coupled at one end to an outlet of one of the pouches, and a user actuated valve connected at one end of the hydration tube distal from the outlet, wherein the check valve is open to allow fluid to flow from the flexible pouch when the hydration tube is coupled to the flexible pouch and the check valve is closed to prevent fluid from flowing from the flexible pouch when the hydration tube is decoupled from the flexible pouch, such that the pouch may be disconnected from the hydration tube and replaced with another pouch from the supply of prefilled, flexible pouches without leakage.

Optionally, each of the flexible pouches may include at least one integral thermal medium section. In a preferred embodiment the user actuatable valve is a bite valve. Optionally, the system further includes a coupling connected to the hydration tube that includes a latch mechanism to avoid inadvertent disengagement of the hydration tube from the flexible pouch. Such coupling may be provided in-line with the tube and, preferably, is positioned adjacent to the outlet. The coupling may be attached to the tube using hose barb type fittings.

In one preferred embodiment the outlet is positioned substantially near the bottom of each of the flexible pouches. Each of the flexible pouches may include baffles for shape retention when filled and as the pouch is emptied.

The present hydration system may further include a threaded connector attached to an end of the tubing away from the user actuated valve, and a quick disconnect connector including flanges attached to the threaded connector, wherein the outlet includes seat openings for accommodating the flanges and the check valve includes a spring biased valve stem. Preferably, the quick disconnect connector includes an O-ring connected thereto.

Further, the present hydration system may further include an elbow connector attached to the end of tubing away from the user activated valve, the elbow connector including a male portion for engaging a portion of the check valve to cause the check valve to open when the elbow connector is attached to the outlet.

Additionally, the present invention is directed to a method for hydrating a person which includes the steps of providing a first prefilled, flexible pouch having a potable liquid therein, the pouch having an outlet for passing liquid from the pouch and including a check valve, providing a hydration tube having a first end and a second end, removably coupling the hydration tube at the first end thereof to the pouch outlet, thereby opening the check valve and allowing the liquid to flow from the pouch through the hydration tube, providing means for consuming the liquid through the second end of the hydration tube, decoupling the first prefilled, flexible pouch from the hydration tube upon consumption of at least a portion of the liquid therefrom, the check valve precluding the liquid from flowing from the pouch upon decoupling, providing subsequent prefilled, flexible pouches each having a potable liquid therein, each pouch having an outlet for passing liquid from the pouch and including a check valve, and repeatedly coupling, consuming, and decoupling the subsequent pouches.

While any of these advantages are possible, it may be the case that only some or even none of them are made use of in connection with the present invention. Furthermore, those with skill in the art may appreciate other advantages not expressly mentioned herein.

Whatever the case, the present invention includes systems comprising any of these features described herein. Methodology described in association with the devices disclosed also forms part of the invention. The invention further comprises such hardware and methodology as may be used in connection with that described which is incorporated by reference.

BRIEF DESCRIPTION OF THE DRAWINGS

Each of the following figures provides examples diagrammatically illustrating aspects of the present invention. Variation of features of the invention and collateral equipment shown is contemplated.

FIG. 7A illustrates a perspective view of a hydration pouch that includes compartments for retaining the shape of the hydration pouch. FIGS. 7B and 7C are cross section views of the pouch of FIG. 7A taken at lines A and B respectively.

DETAILED DESCRIPTION OF THE INVENTION

Before describing variations of the present invention in detail, first it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process step or steps, to the objective, spirit and scope of the present invention. All such modifications are intended to be within the scope of the claims made herein. Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either both of those included limits are also included in the invention. Also, it is contemplated that any optional feature of the inventive variations described herein may be set forth and claimed independently, or in combination with any one or more of the features described herein.

Unless defined otherwise, all technical and scientific terms used herein have the same meaning as commonly understood by one of ordinary skill in the art to which this invention belongs. Although any methods and materials similar or equivalent to those described herein can also be used in practicing the present invention, the preferred methods and materials are described. All existing subject matter mentioned herein (e.g., publications, patents, patent applications and hardware) is incorporated by reference herein in its entirety. [MSOffice2] The referenced items are provided solely for their disclosure prior to the filing date of the present application. Nothing herein is to be construed as an admission that the present invention is not entitled to antedate such material by virtue of prior invention.

Also, it is noted that as used herein and in the appended claims, the singular forms "a," "and," "said" and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely," "only" and the like in connection with the recitation of claim elements or the use of a "negative" claim limitation(s).

Figure 1:
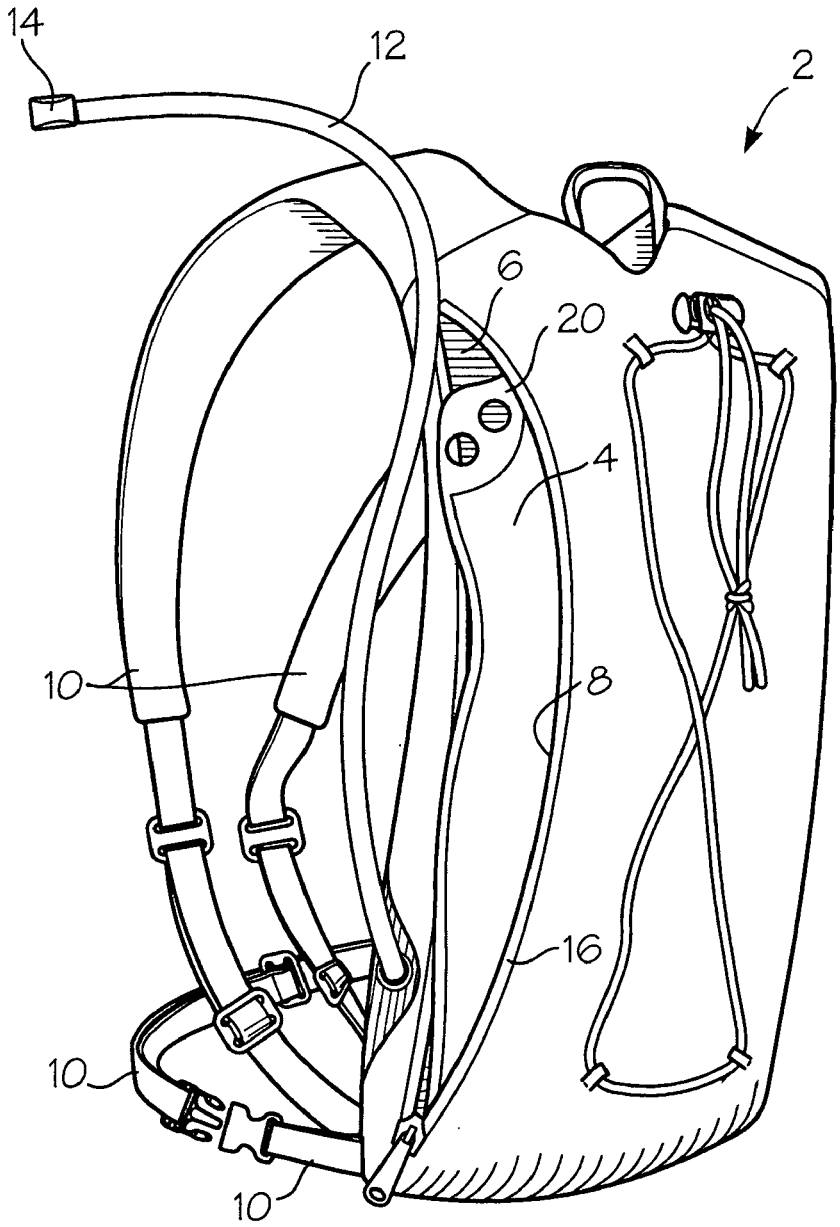
FIG. 1 shows a perspective view of a hydration system of the present invention.

Turning now to FIG. 1, the inventive system may include a pack 2 adapted to house a hydration pouch 4. Various manufacturers produce packs suitable for such use. Exemplary packs include those sold by K2 Bike (Vashon, Wash.), CamelBak (Weatherford, Tex.), Blackburn Designs (San Jose, Calif.), and Performance Bicycle Inc. (Chapel Hill, N.C.).

Pack 2 includes a housing portion 6 with an access zipper 8 and straps 10. Hydration pouch 4 is shown within the pack 2. The pouch 4 shown connects to a conduit 12 that includes a bite valve 14 at an end thereof for preventing inadvertent draining of the pouch 4. Conduit 12 may be insulated. For instance a neoprene sleeve (not shown), such as produced by Lizards Skins (Pleasant Grove, Utah) may be used. Valve 14 is preferably a bite valve operated by the jaws and teeth of a user.

Figure 2A:
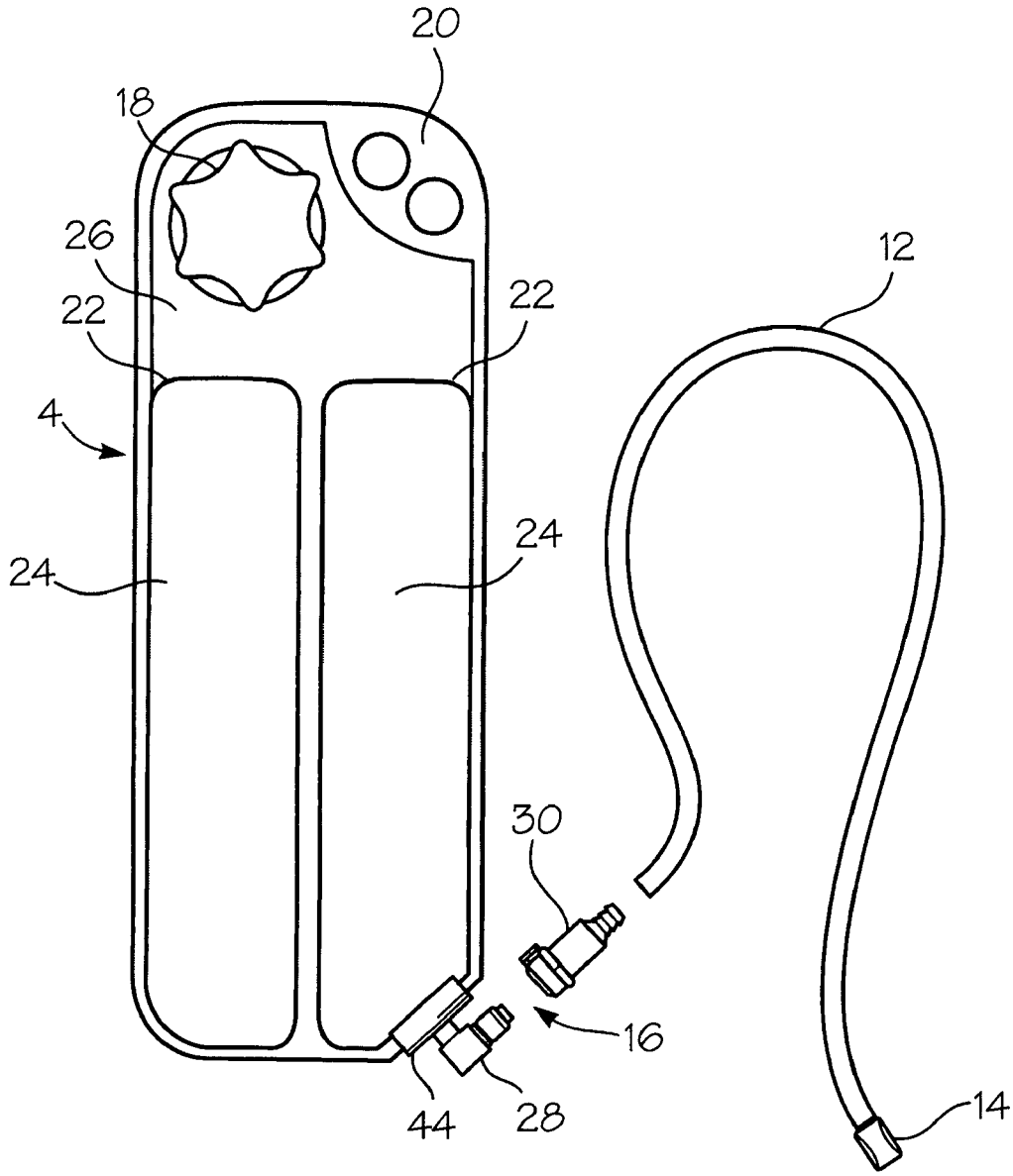
FIG. 2A shows an exploded view of a pouch system including one embodiment of a hydration line coupler setup according to the present invention.
Figure 3A:
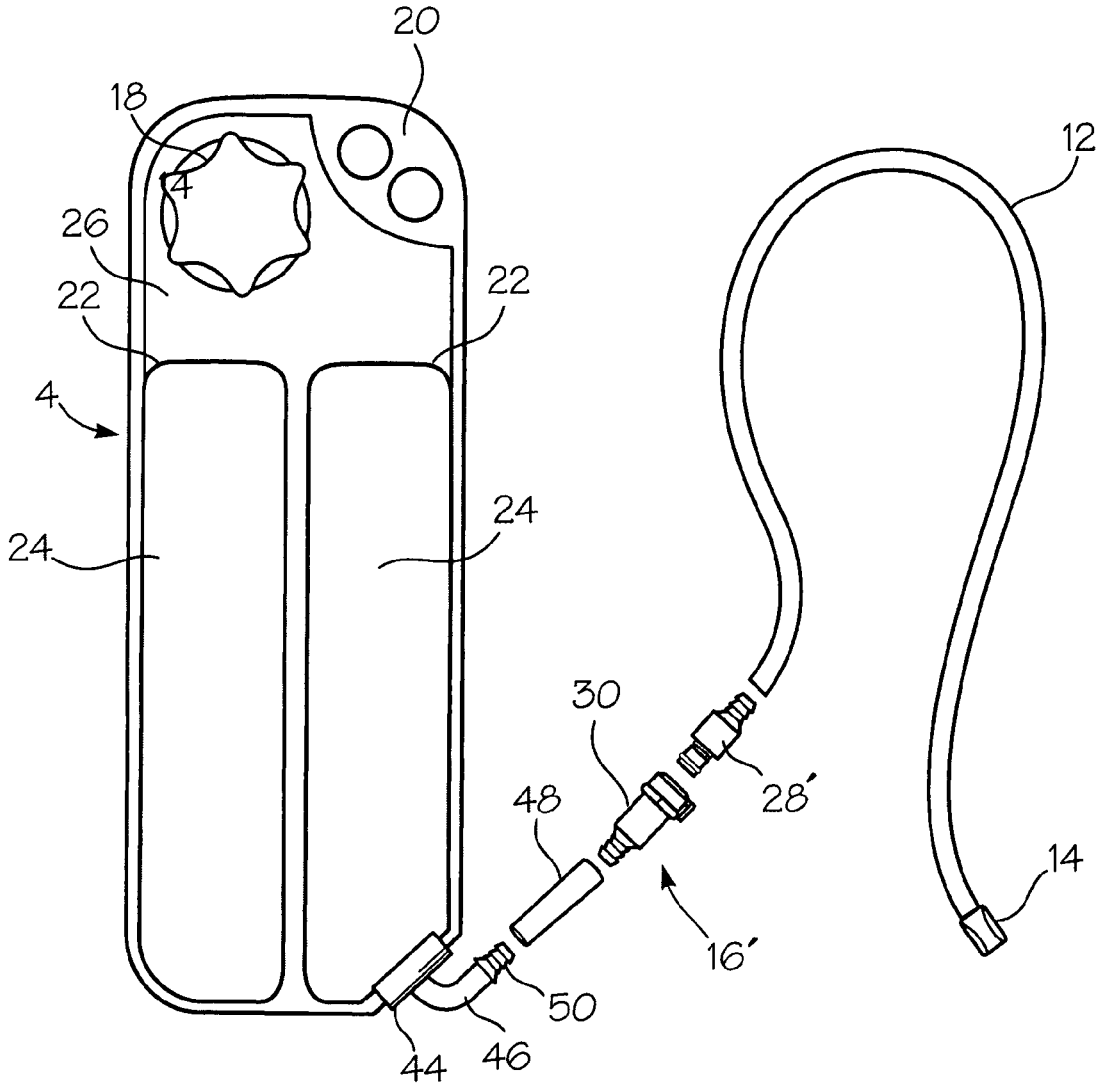
FIG. 3A illustrates an exploded view of another embodiment of a pouch system including a second hydration line coupler according to the present invention.

As shown in FIGS. 2A and 3A, the conduit 12 connects to the pouch 4 via a fitting assembly 16 or 16'. The pouch 4 includes a sealable opening 18 through which the pouch 4 may be filled. A screw-type cap is shown, although a snap or press-fit baffle or another structure may be provided. The pouch shown also includes a hanger section 20. The inlet of the conduit 12 is attached at a lower portion of the pouch 4 when it is to be utilized in conjunction with a backpack as shown in order to facilitate full evacuation of liquid from the pouch 4.

Portions of the pouch 4 intended to contact fluid for drinking preferably comprise such materials as commonly used in other flexible hydration bags, pouches, bladders or the like produced by companies such as Gregory Manufacturing Inc. (Holeyoke, Mass.) and Dielectrics (Chicopee, Mass.). Suitable materials include, but are not limited to polyethylene (sold as CXC material produced by Hyclone (Logan, Utah)), urethane, polyurethane, polystyrene, and nylon.

Pouch 4 including the connector features of the present invention may be utilized as part of a larger hydration system including a backpack or harness 2 or be used independent of such structure. Furthermore, any type of hydration bladder, such as various models presently sold by CamelBak, Pladapus or K2 may be used in connection with the present invention.

Figure 2B:
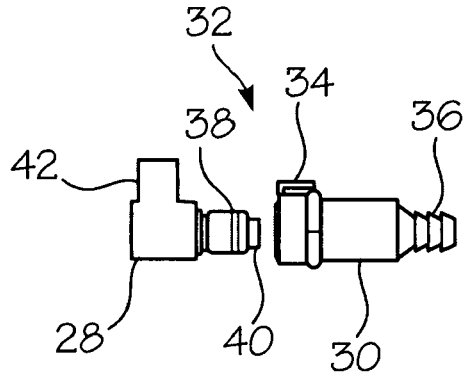
FIG. 2B is an elevation view of the coupler shown in FIG. 2A.

However, a pouch 4 including integral thermal capacitance medium as shown in FIGS. 2A and 3A from the front and in FIG. 1 from behind is most preferred. Suitable integrally cooled (or heated) hydration pouches are described in U.S. patent application Ser. Nos. 09/653,816 filed Sep. 1, 2000 and 10/043,657 filed Jan. 8, 2002 may be used to implement the present invention. As shown in FIGS. 2A and 2B, pouch 4 includes adjacent pockets 22 filled with a thermal capacitance medium 24.

The thermal medium 24 may be water, a gel or other material that may be effectively chilled and/or heated. The material or materials chosen should have a high specific heat or heat capacity in order to best cool and/or heat or maintain a low or a high temperature of fluid within the pouch 4. A preferred medium 24 for cooling comprises a non-toxic refrigerant gel of conventional formulation. Compositions that may be suitable for medium 24 include water and propylene glycol or a cellulose ether, those described in U.S. Pat. Nos. 5,035,122; 6,044,201 (and the references cited in each), those used/produced by Consolidated Products and Services, Inc. (Braintree, Mass.), or as used in commercially available gel packs for cooling and/or heating including Nexpare™ (3M: St. Paul, Minn.), PolyBag™ (Super Ice Corporation: San Leandro, Calif.).

The pouch variation shown in FIGS. 2A and 3A is advantageously formed by a plurality of heat-sealed or welded layers. A pair of layers provide for a fluid compartment 26 that accessed by sealable opening 18 while another external layer forms each of pockets 22.

As referred to above, conduit 12 is preferably placed in fluid communication with the hydration pouch at or near its bottom to facilitate complete evacuation of its potable contents. In one aspect, the present invention is concerned with the manner in which the conduit attaches to the hydration pouch—regardless of its location.

Figure 3B:
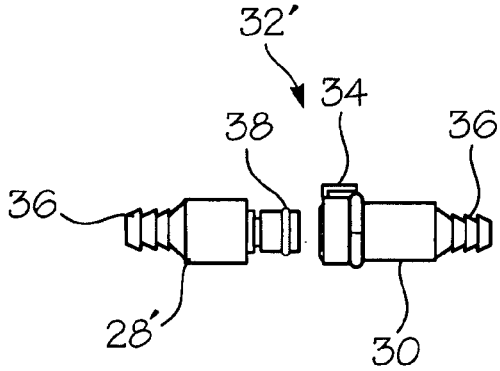
FIG. 3B is an elevation view of the coupler shown in FIG. 3A.

FIG. 2A shows one manner of connection. It involves a fitting assembly 16 utilizing the components shown in enlarged view FIG. 2B. FIG. 2B details a preferred male coupling portion 28 and a female coupling portion 30. FIG. 3A shows another manner of connection. It involves a fitting assembly 16' utilizing the components shown in enlarged view FIG. 3B. FIG. 3B details another preferred male coupling portion 28' and a female coupling portion 30. The female coupling portions preferably include an internal check valve discussed hereinafter.

Each of the coupling portions shown is a variation of those produced by Air-Oil Products Corp., (Pneumatic Group—Portland, Oreg.). Specifically, ¼ inch or 5/16 inch I.D. tubing size fittings in the "APC" or "PLC" product line are preferred. Primary valve components are preferably produced from plastic, such as Acetyl thermoplastic, but metal may be used, especially corrosion resistant metals, such as stainless steel. Plastic components are preferred for low cost, while offering acceptable durability.

In each fitting combination 32/32', fluid is able to pass freely through the members when they are engaged. When disengaged as shown, at least the portion of the coupling combination that is directly connected to the pouch is shut-off or closed-off to flow. It is possible, however, to configure either valve portion with manual valve-release features to allow a user to override valve closure function in order to drain fluid contents and/or purge air from the hose or pouch.

Depending of the valve configuration, either the male or female portion may be fastened onto the pouch 4. FIGS. 3A and 3B merely show two optional valve placement configurations. However, at minimum, a check valve is incorporated in the bag-side valve portion to seal off the contents of pouch 4 and prevent them from escaping when the conduit 12 is detached.

For the valve portions pictured, female valve body 30 preferably includes a depressible release lever 34 and associated internal locking mechanism so members 28/28' and 30 decouple only when desired. For connection to tubing 12, hose barb sections 36 are preferably used. Such ferrule-less fittings conveniently attach to any sort of semi-rigid or flexible tubing. Of course, other fitting end types may be employed.

With the male fitting portions shown, an optional O-ring seal 38 is provided to help avoid leakage between the male and female body portions when engaged. In the valve variation shown in FIG. 2B, the male valve portion includes a spring-loaded valve core 40 to alternately seal and open this valve portion to liquid flow. Generally, the valve core is depressed upon engaging the valve portions. When provided with its own valve assembly, male portion 28 is suitable for use adjacent pouch 4 as shown in FIG. 2A.

The complimentary female coupling portion shown in FIG. 2A may or may not include a check valve. It is convenient when it does include a valve since this will seal off any contents in line 12 to prevent their leakage therefrom whilst the conduit 12 is disconnected from pouch 4.

In the configuration of the invention shown in FIG. 3A, male body portion 28' (detailed in FIG. 3B) is without a valve core 40 as shown in the variation in FIGS. 2A and 2B. It is always open to flow. As such, it does not ensure that contents of line 12 will not escape when the valve portions are disengaged. Still, liquid in the line will tend to remain intact by virtue of closure of valve 14, which acts like a finger plugging the end of a straw. It may be desired to use a valve combination in which the line-side member does not include its own shutoff valve (whereas the bag-side portion still does as shown in FIG. 3A) in order to conserve costs.

Of course, other types or sizes of fittings or fitting portions may be employed in the present invention. What is of interest is a fitting assembly that can be easily connected and disconnected, always leaving an end in association with a pouch that serves as a check valve or shut-off valve preventing inadvertent drainage.

With respect to preferred embodiments of the invention shown, however, FIG. 2A illustrates a more integrated approach than that shown in FIG. 3A. It preferably achieves an integrated approach by directly connect an angle connector section 42 of connector portion 28 (or 30) to a pouch interface portion 44. The members may be connected using a press fit, a threaded interface or they may be otherwise connected—such as by providing the members in an integral piece. In any case, interface portion 44 (in variations of the invention shown in the figures) is preferably captured and welded to opposing layers of bladder 4 to form a fluid-tight seal around its periphery with the bag.

Regardless of the constructional details, valve assembly 16 in FIG. 2A is completed by pushing the member shown broken apart together. Conduit 12 remains attached to valve portion 30 in use, but the valve portions are easily engaged and disengaged as desired. Valve assembly 16' in FIG. 3A is similarly completed by pushing its respective members together.

The extension may take the form of an elbow joint or it may be straight. Accordingly, a typical pouch may be transformed into one according to the present invention by inserting a valve combination 32 in-line with its existing hydration line as shown.

A user would simply cut the hose or line and press the fitting in place. Preferably the coupling is situated in close proximity/adjacent to the body of the pouch and its outlet. A tubular bridge portion 48 is used in this embodiment of the invention to place the check-valve in fluid communication with the pouch exit fitting or extension section 46, whether the valve portions are used in a retrofit kit or not. The length of the bridge tubing may be varied as desired. Still it is preferably sized so less than about 3 inches of free tubing are provided between the ends of the coupling portions; more preferably, between 1 and 2 inches are provided. While the present invention encompasses different length extension sections, shorter ones will tend to kink, and longer ones not take full advantage of the convenience offered by more preferred designs. It may be connected to the pouch fitting utilizing hose barbs 50 or whatever other manner is convenient, including a hose clamp or otherwise.

Returning to FIG. 1, the functional value of being able to release and install a hydration pouch separate from a feed line or conduit 12 becomes apparent. Typically, the conduit is threaded from the inside of a bag or harness from the inside out as shown. It may pass through or be tied down by various members in order to confine its path while in use or for storage. The ability to detach pouch 4 from the hose can tremendously expedite bladder placement, change-out and hydration system preparation. Replacing a hydration bladder with a full one, or returning a filled bladder (neither one being connected to a capped hose or line in accordance with the present invention) to bag 2 is feasible due to the check-valve which keeps the bladders' contents intact without resort to holding it at an awkward angle or manually stopping any openings with a finger or the like.

Handling of a detached pouch 4 is improved over one attached to a hydration line in another respect. A detached pouch according to the present invention may be stored, refrigerated, warmed or filled without a user getting tangled in a lengthy piece of tubing. In addition, other advantages and uses may be apparent to one with skill in the art.

Figure 4:
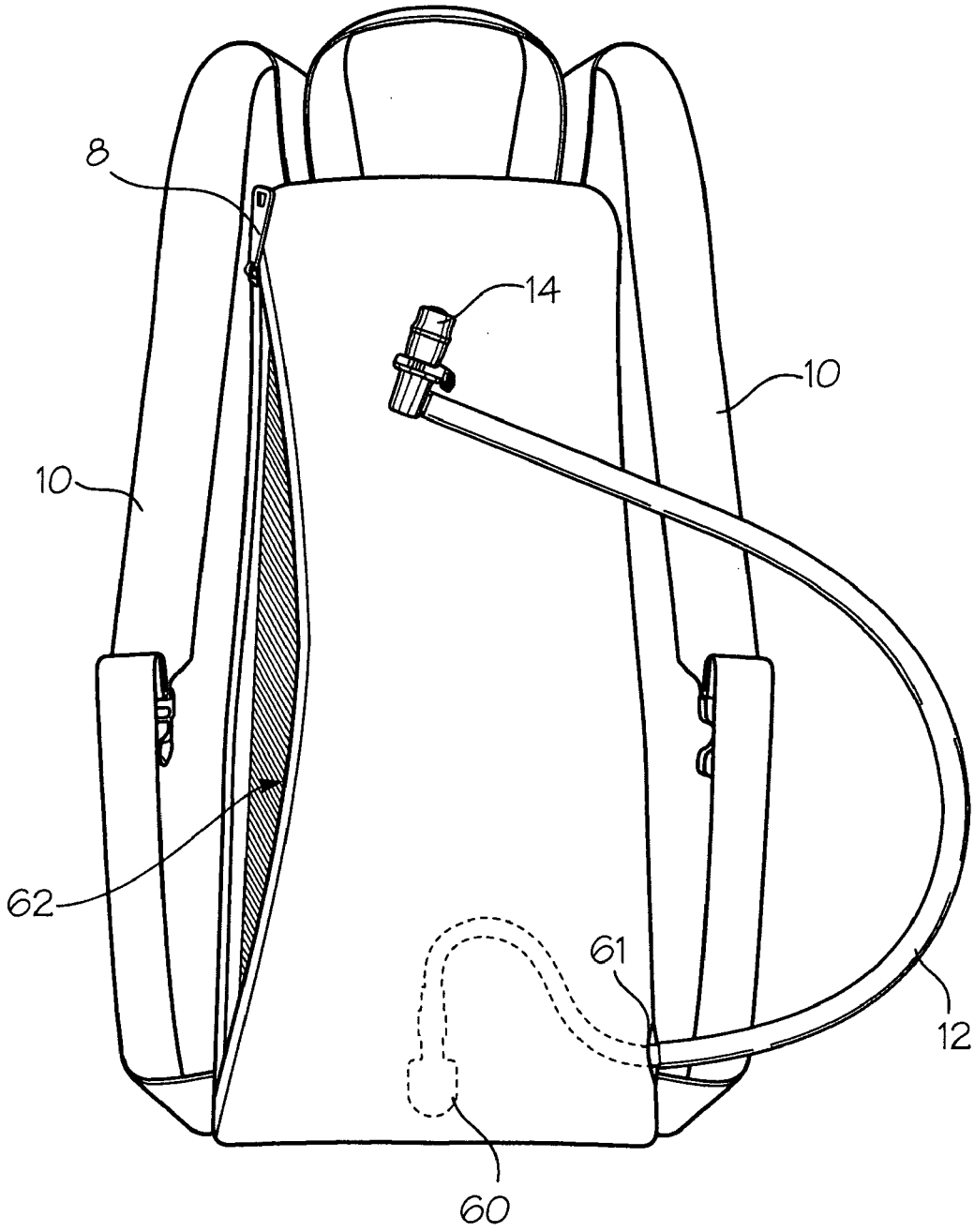
FIG. 4 depicts a perspective view of a further embodiment of the hydration system of the present invention.

Turning now to FIG. 4, a pack 2 includes straps 10 and a zipper 8 for providing access to a hydration pouch compartment. A hydration pack (not shown) is removably affixed within the pack 2. Conduit 12 attaches at one end to the hydration pouch via a connector 60 (represented in phantom) and passes through an opening 61 in the hydration pouch compartment 62 to an exterior of the pack 2. A bite valve 14 is affixed at an end of conduit 12 distal from the hydration pouch.

Accordingly, the user may remove an empty or nearly empty pouch from the hydration pouch compartment 62 and easily replace it with a filled pouch. Thus, in a preferred embodiment the present invention is directed to a hydration system, which employs prefilled, disposable hydration pouches, which may be quickly and easily removed and replaced without leakage. That is, while the hydration pouches of the present invention illustrated in FIGS. 2A and 3A are intended generally for repeated filling and reuse by a consumer, the pouches shown in FIGS. 5 and 6A through 6D preferably are formed and filled at a centralized packaging facility for a single use, replacement and disposability. Although a durable, reusable pouch may be preferred in many environments, certain situations call for the convenience of a prefilled, replaceable, disposable pouch. For example, in military applications a large number of soldiers can more quickly receive prefilled pouches from a central stock and replace and dispose of used pouches than they can refill reusable pouches. Other situations in which prefilled, disposable pouches may be preferred include sporting events with a large number of participants and activities in regions where potable water is inaccessible or not easily accessible. Alternatively, premium fitness waters or sports drinks may be provided in prefilled disposable pouches for consumption by individual users in accordance with the present invention.

The key to a hydration system based on prefilled, disposable pouches is the check valve of the present coupling device, which allows for removal and replacement of pouches without leakage. Preferred mechanisms for this check valve are discussed in greater detail below. It should be noted that, as with disposable plastic water bottles, although the present prefilled pouches are disposable, the individual consumer may advantageously refill and reuse the pouch several times by filling the pouch through conduit 12 and port 44. The present check valve allows for flow of fluid into the pouch upon engagement of the coupler.

Figure 5:
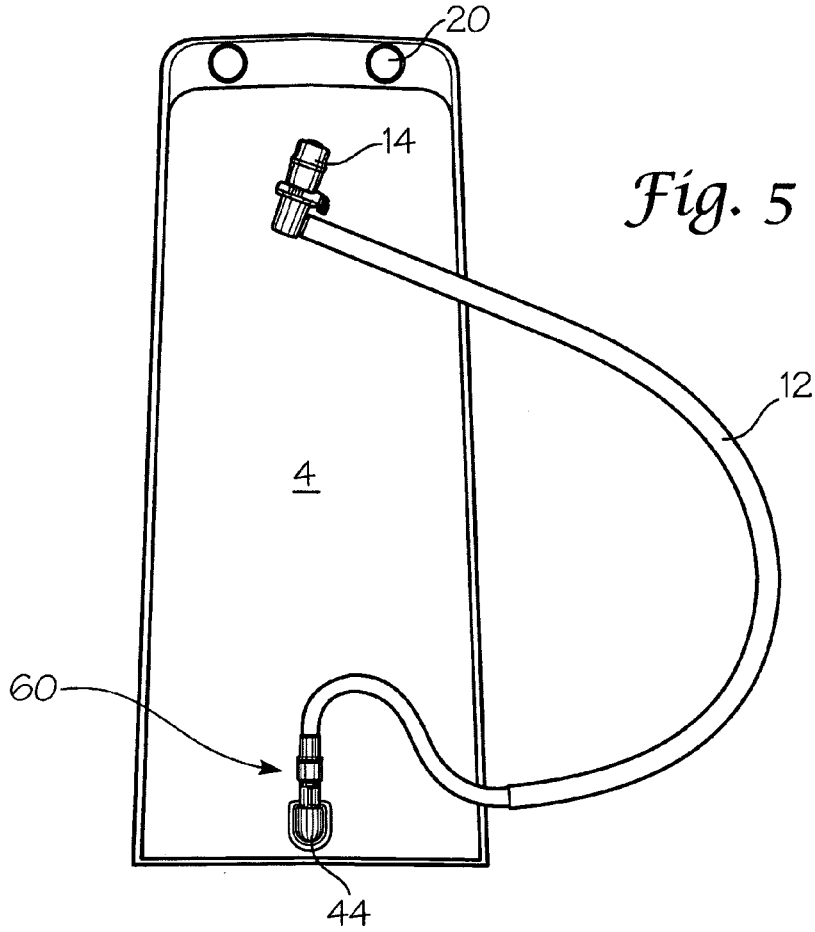
FIG. 5 shows a perspective elevation view of a pouch for use in the hydration system of FIG. 4.

FIG. 5 depicts hydration pouch 4 including hanger section 20. The hanger section 20 typically includes a plurality of reinforced holes. Hooks, hangers, straps or the like are included in the hydration pouch compartment and pass through the reinforced holes to secure the hydration pouch within the hydration pouch compartment. Conduit 12 connects at one end to a port 44 via a quick disconnect connector 60. Bite valve 14 connects at an opposite end of conduit 12. As discussed above, a check valve arranged within port 44 prevents fluid contents from the interior of the hydration pouch from flowing from the pouch when connector 60 is decoupled from the pouch. Likewise, bite valve 14 prevents fluid from flowing from the conduit 12 when decoupled from the pouch. When the assembly is to be stored for extended periods of time, a user can actuate bite valve 14 to drain the fluid contents therefrom.

Figure 6A:
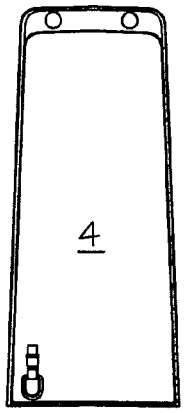
FIGS. 6A through 6D depict various perspective views showing different arrangements and positions of the hydration line bag port.
Figure 6B:
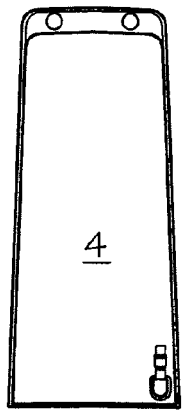
Figure 6C:
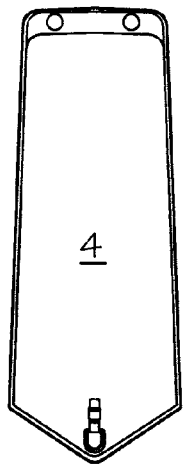
Figure 6D:
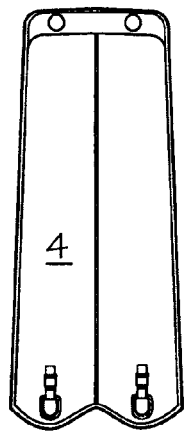

FIGS. 6A and 6B depict various positions where the port 44 is preferably located. In FIG. 6C, the hydration pouch includes sloped edges that effectively drain the fluid contents of the pouch towards the port 44. In FIG. 6D, the pouch includes two separate compartments for holding two liquids. It should be noted that the port 44 may be located on the bottom of the pouch to effectively allow all fluid to drain from the pouch.

FIG. 7A is a cross section view showing baffles 63 that provide support for the hydration pack. Thus, the hydration pouch maintains its shape and the side walls 64 do not balloon outwardly when filled with fluid or sag as the fluid is drained from the bag. As can be seen in FIGS. 7B and 7C, the baffles 63 are flexible such that the side walls 64 collapse towards one another as the fluid within the pouch is drained.

Figure 8A:
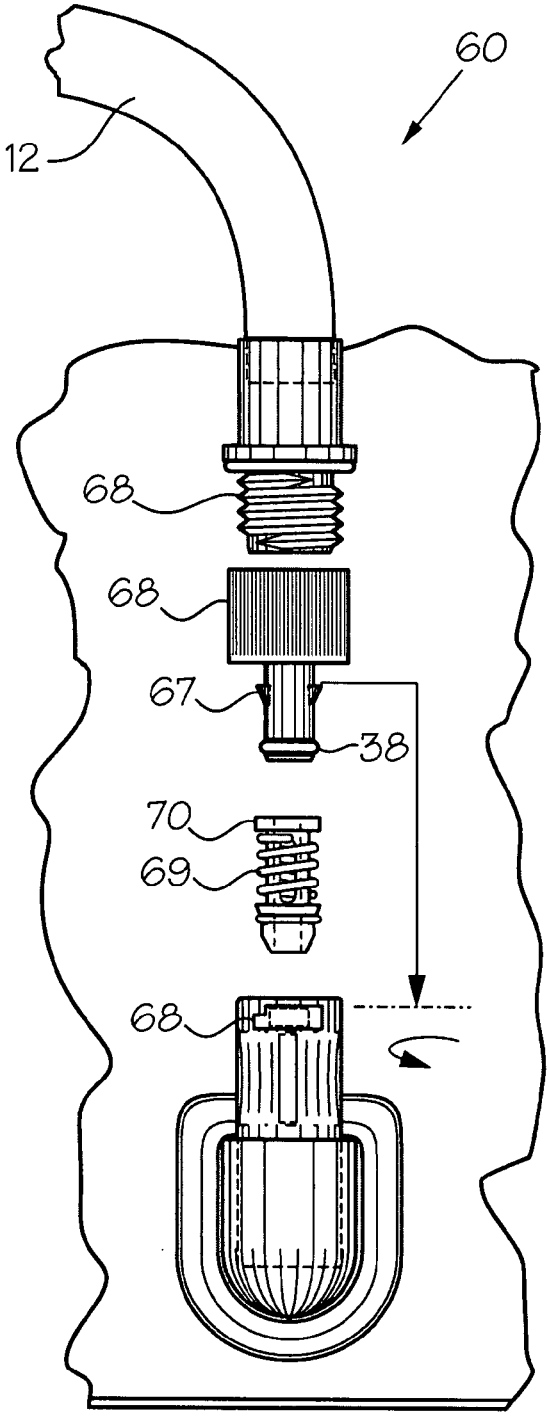
FIGS. 8A and 8B are exploded views of an embodiment of a hydration line coupler including a bag port according to the present invention.
Figure 8B:
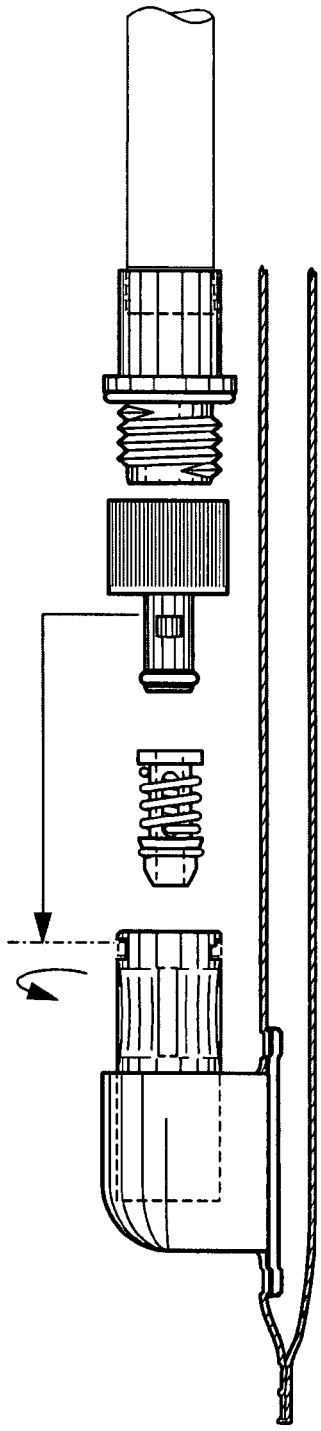

FIGS. 8A and 8B are exploded views of the quick disconnect connector 60. The connector 60 comprises a threaded end fitting 65 that is affixed at an end of the conduit 12 opposite bite valve 14. The end fitting 65 includes external threads for accepting a quick connect portion 66. An O-ring 38 is seated at an end of the quick connect portion 66. Flanges 67 are included on the quick connect portion 66 for coupling the quick connect portion 66 to the port 44. Port 44 includes seat openings or recesses 68 for accommodating flanges 67. A spring biased valve stem 69 seals the port 44 when the connector 60 is disengaged from the port.

Figure 9A:
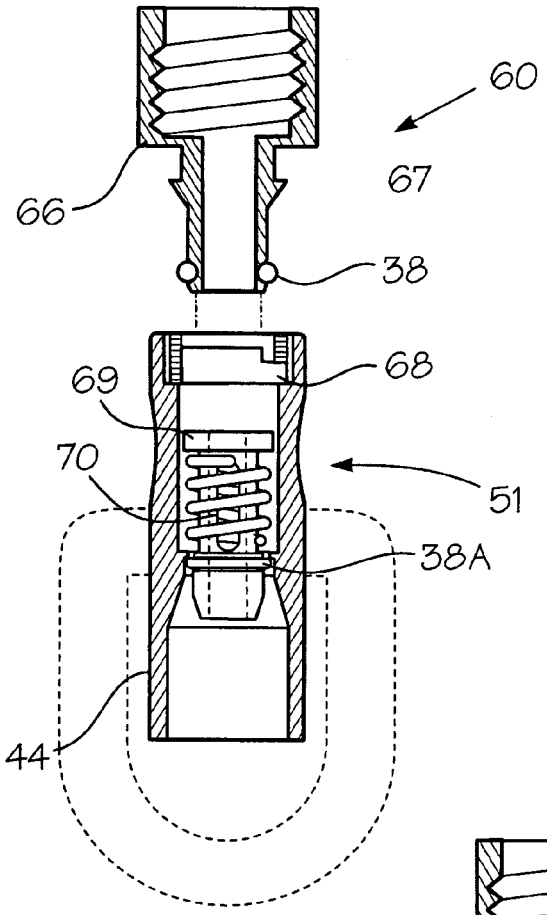
FIGS. 9A through 9C are cross section views of the hydration line coupler of FIGS. 8A and 8B with the bag port shown in phantom.
Figure 9B:
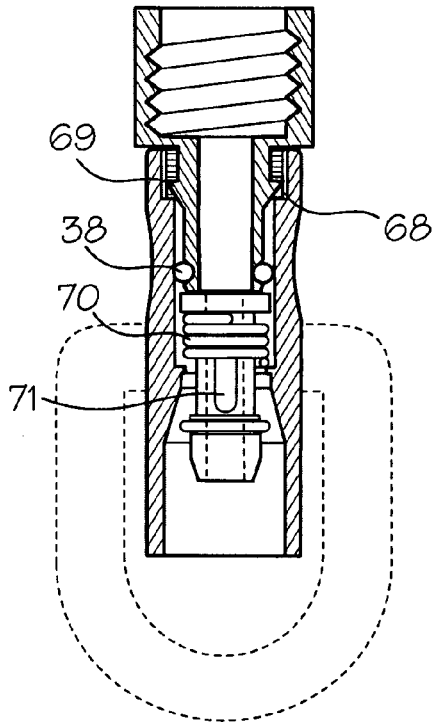
Figure 9C:
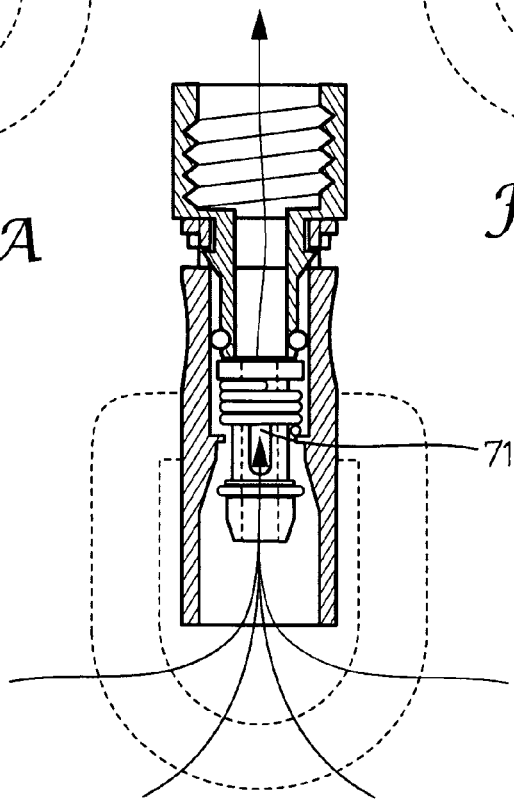

FIGS. 9A through 9C are cross section views of the connector 60 shown in FIGS. 8A and 8B. FIG. 9A depicts the check valve assembly 51 in a closed position. In this instance, the connector 60 is decoupled from the port 44. Spring 70 which is seated within port 44 biases valve stem 69 towards a closed position to seat an O-ring 38A to prevent fluid from flowing from the pouch. In FIG. 9B, the connector 60 is coupled to port 44. Flanges 67 are inserted into seat openings 68 thereby causing quick connect portion 66 to push valve stem 69 further into port 44 and overcoming the biasing force of spring 70 to compress it. As can be readily realized by a skilled artisan, the quick connect portion 66 is forced into the port 44 and twisted such that flanges 67 are seated within seat openings 68. The process is reversed to disengage the connector 60. When engaged, fluid from the interior of the pouch flows through an opening 71 in the valve stem 69 and into conduit 12 as represented by the arrows shown in FIG. 9C.

Figure 10A:
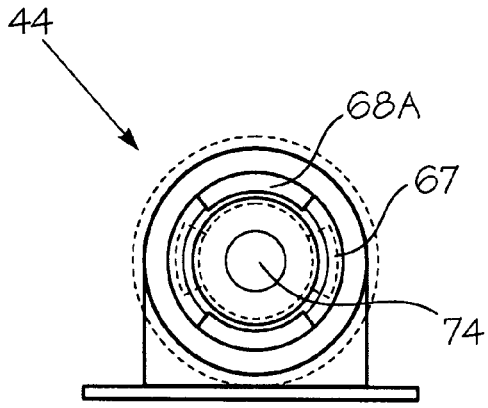
FIGS. 10A and 10B are end views of the bag port shown in FIGS. 8 and 9 and representing the hydration line connector shown in phantom.
Figure 10B:
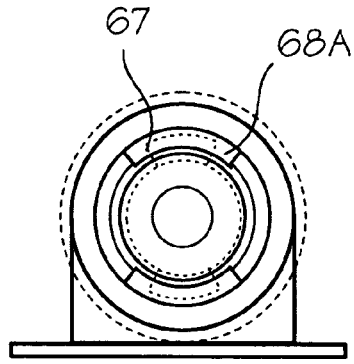
Figure 10C:
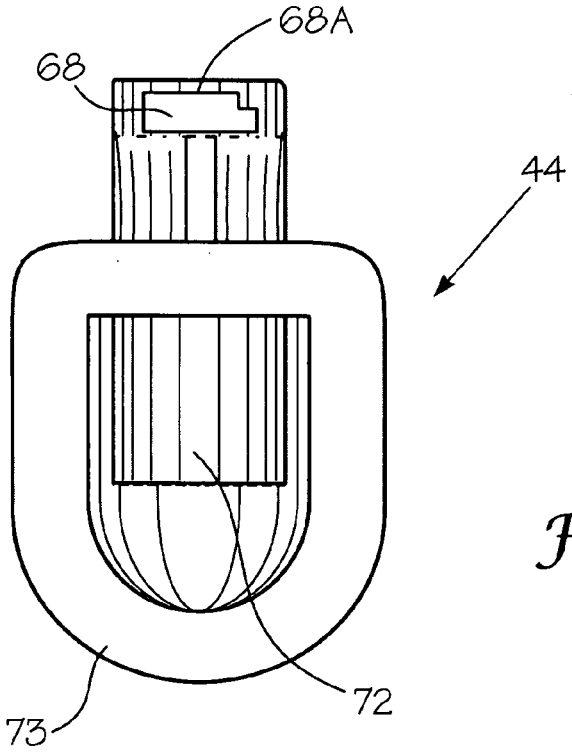
FIG. 10C is an elevation back side view of the bag port shown in FIGS. 10A and 10B.

FIGS. 10A through 10C are end views of the port 44 and show the flanges 67 of quick connect portion 66 in phantom. FIG. 10A depicts the flanges 67 in an unseated position. FIG. 10B shows the flanges 67 in a seated position. Seat openings 68 include an upper lip 68A. Quick connect portion 66 is inserted into bag port 44 and rotated to lock flanges 67 into seat openings 68. The biasing force created by spring 70 forces the flanges 67 against upper lips 68A to seat the connector 60. The connector 60 is then rotated in an opposite direction to release the connector 60 from the bag port 44. FIG. 10C is an elevation view of the bag port 44 and showing the opening 72 in bag port 44. Fluid from the pouch 4 passes through opening 72 which communicates with opening 74 when valve stem 69 is open. A flange 73 is provided on bag port 44 for fastening the bag port 44 to the pouch 4 via a heat welding technique or adhesive.

Figure 11A:
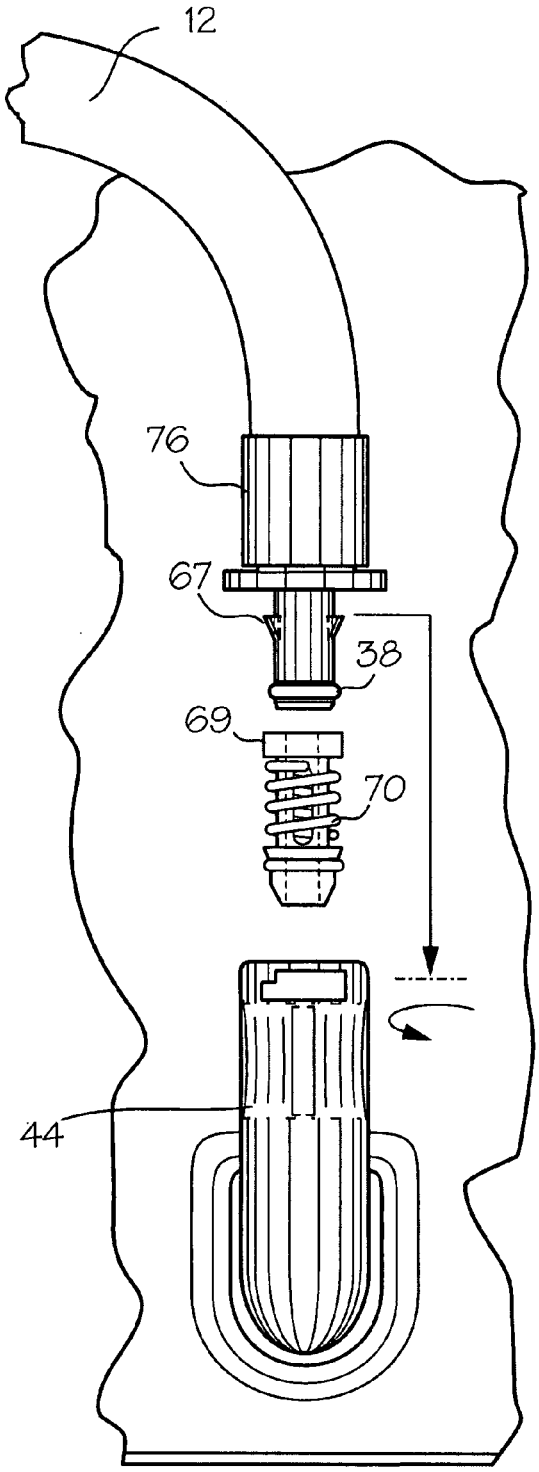
FIG. 11A shows an exploded view of another embodiment of a hydration line coupler including a bag port according to the present invention.
Figure 11B:
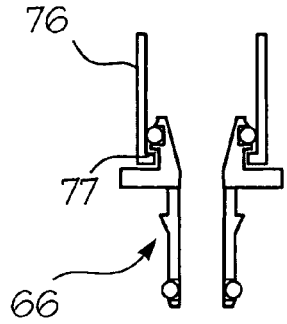
FIG. 11B is a cross section view of the quick decoupling connector shown in FIG. 11A.

FIG. 11A is an exploded view of another embodiment of a connector 75 for use in the invention. The connector 75 is similar to the previously mentioned connector 60. Bag port 44 includes a spring biased valve stem 69 and seat openings 68 as in the previous embodiment. However, the connector 75 is heat or sonic welded onto an end of conduit 12. The connector includes a swivel 76 to which quick connect portion 66 attaches. Quick connect portion 66 includes a recess 77 for accommodating an o-ring 38 as shown in FIG. 11B. Thus, the quick connect portion 66 may be rotated to seat within port 44 without administering any stress to the welded portion of the connector.

Figure 12B:
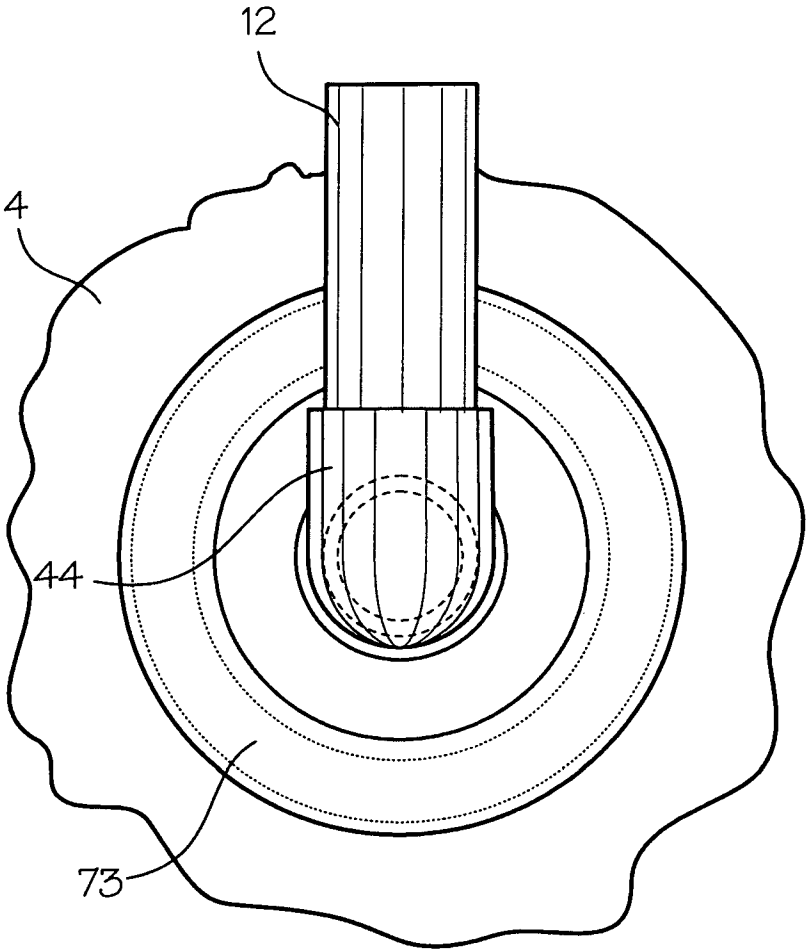
FIG. 12B is a perspective elevation view of the coupler shown in FIG. 12A.
Figure 12A:
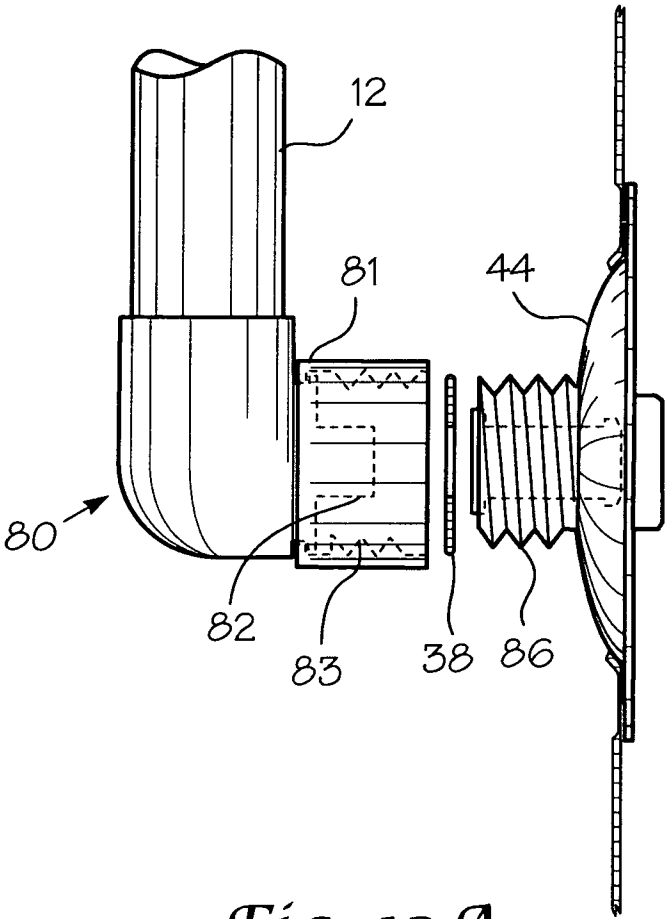
FIG. 12A is an exploded view of a 90-degree elbow hydration line coupler including a bag port.
Figure 13B:
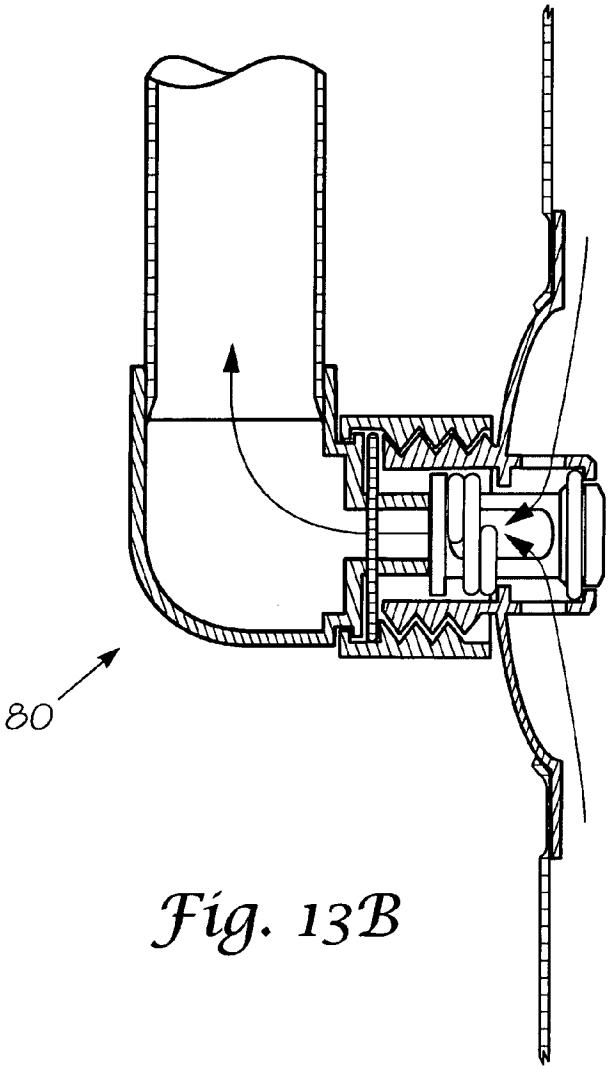
FIGS. 13A and 13B are cross section elevation views of the hydration line coupler of FIGS. 12A and 12B showing the coupler when disconnected and connected, respectively.
Figure 13A:
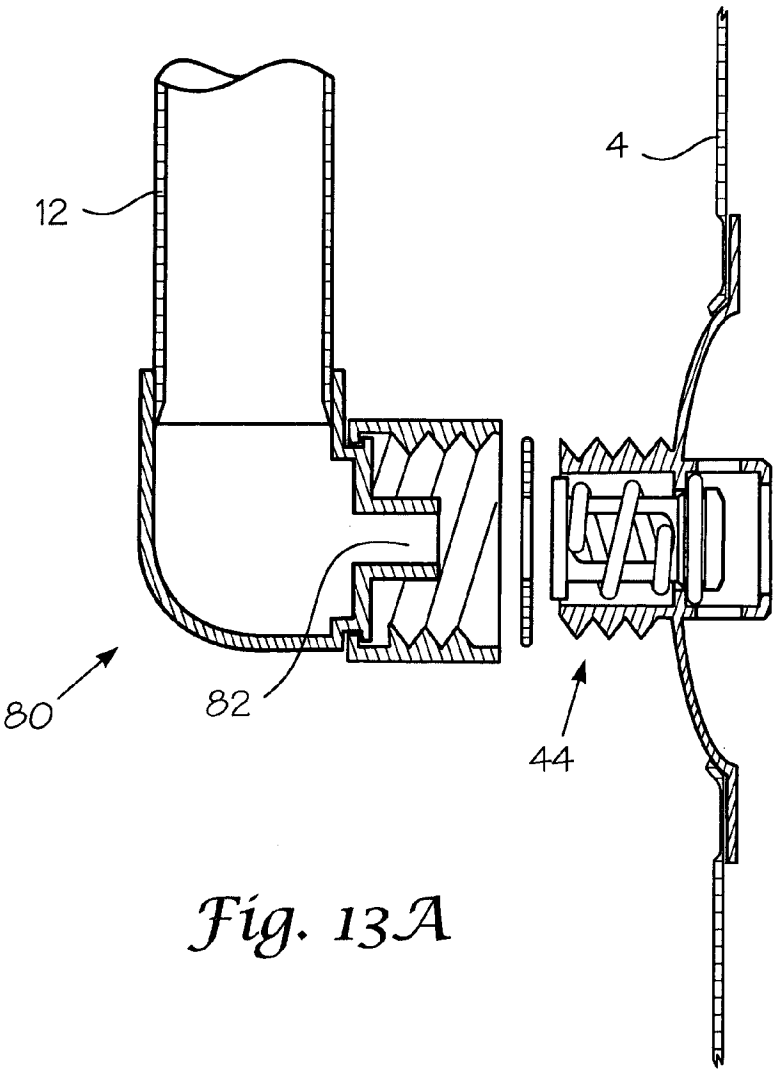

FIG. 12A is an exploded view of an elbow type connector 80. FIGS. 13A and 13B show the elbow shown in FIG. 12A. Port 44 includes a check valve assembly as mentioned above. External threads 85 are provided on port 44 for accommodating internal threads 83 to removably fasten the connector 80 to port 44. An 0-ring 38 is seated between the connector 80 and port 44 to act as a seal thereby preventing fluid from inadvertently leaking. As can be more clearly seen in FIGS. 13A and 13B, connector 80 engages port 44 such that internal threads 83 mate with external threads 85. Swivel 81 is rotated in a clockwise fashion causing male portion 82 to push against check valve 44 causing it to open as shown in FIG. 13B. Fluid, represented by arrows, flows from pouch 4 through port 44 and connector 80 into conduit 12.

Figure 14A:
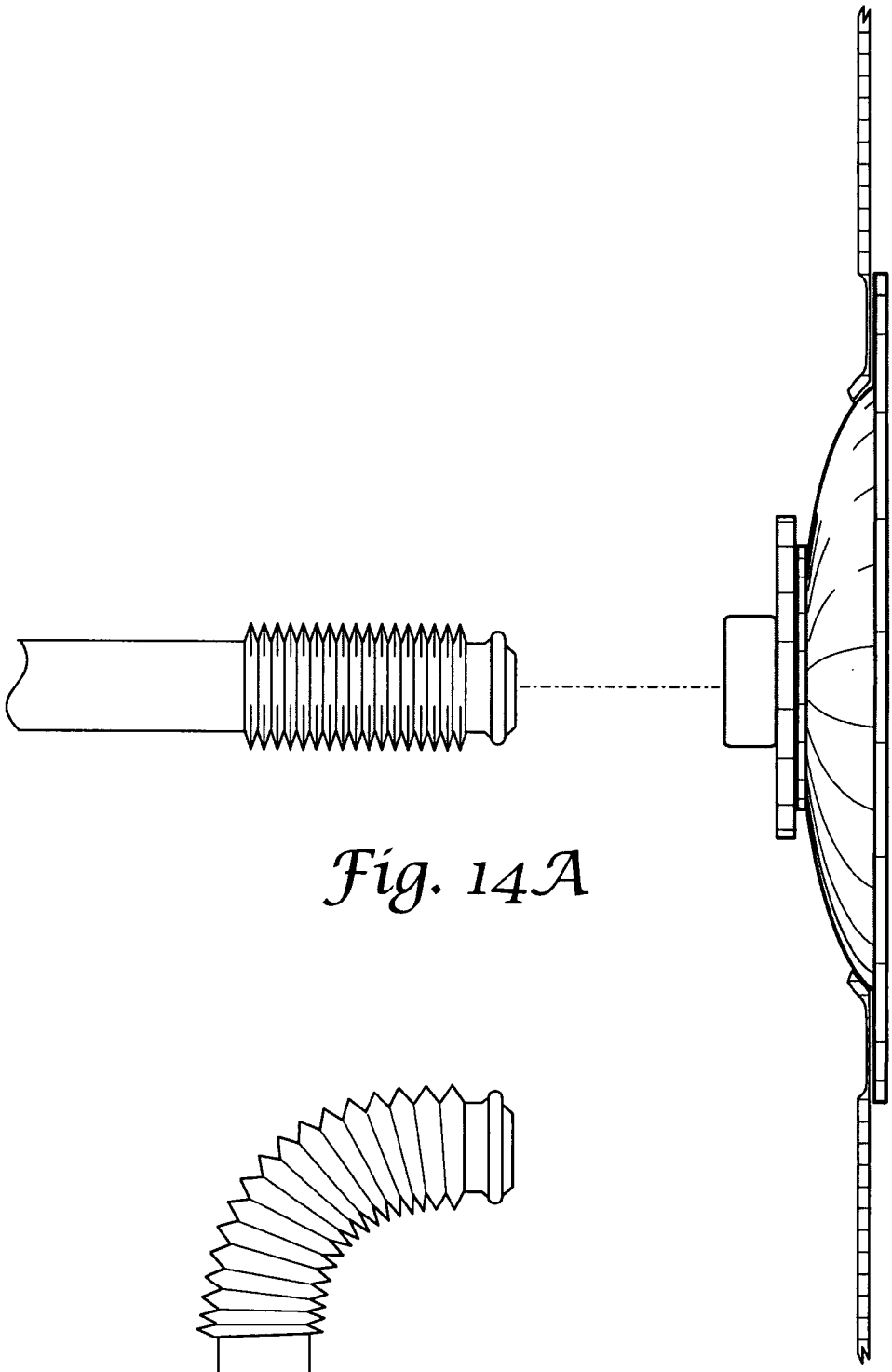
FIGS. 14A and 14B are perspective views of a further embodiment of a hydration line coupling and showing a flexible conduit that includes baffles.
Figure 14B:
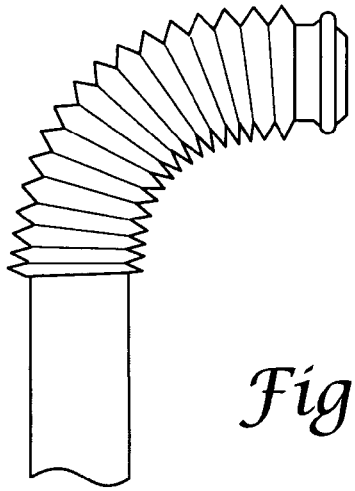

FIG. 14 shows a different type of conduit that may utilized in the invention. In this embodiment, the conduit 12 is equipped with baffles similar to a drinking straw. The baffles necessitate the need for an elbow connector 80 as previously mentioned.

Though the invention has been described in reference to several examples, optionally incorporating various features, the invention is not to be limited to the set ups described or indicated as contemplated with respect to each variation. It is to be understood that the breadth of the present invention is to be limited only by the literal or equitable scope of the following claims.

We claim:

1. A hydration system comprising:

a supply of prefilled, flexible pouches having fluid therein, each of the pouches having an outlet for passing fluid from the pouch and including a check valve;

a hydration tube having two ends and removably coupled at one end to an outlet of one of the pouches;

a user actuated valve connected at one end of the hydration tube distal from the outlet, wherein the check valve is open to allow fluid to flow from the flexible pouch when the hydration tube is coupled to the flexible pouch and the check valve is closed to prevent fluid from flowing from the flexible pouch when the hydration tube is decoupled from the flexible pouch, such that the pouch may be disconnected from the hydration tube and replaced with another pouch from the supply of prefilled, flexible pouches without leakage;

a threaded connector attached to an end of the hydration tube away from the user actuated valve; and a quick disconnect connector including flanges attached to the threaded connector; wherein the outlet includes seat openings for accommodating the flanges and the check valve includes a spring biased valve stem.

2. The system of claim 1, wherein each of the flexible pouches includes at least one integral thermal medium section.

3. The system of claim 1, wherein the user actuatable valve is a bite valve.

4. The system of claim 1, further comprising a coupling connected to the hydration tube that includes a latch mechanism to avoid inadvertent disengagement of the hydration tube from the flexible pouch.

5. The system of claim 4, wherein said coupling is provided in-line with the tube.

6. The system of claim 5, wherein said coupling is positioned adjacent to the outlet.

7. The system of claim 5, wherein said coupling is attached to the tube using hose barb type fittings.

8. The hydration system of claim 1 wherein the outlet is positioned substantially near the bottom of each of the flexible pouches.

9. The hydration system of claim 1 wherein each of the flexible pouches includes baffles for shape retention when filled and as the pouch is emptied.

10. The hydration system of claim 1 further comprising an 0-ring connected to the quick disconnect connector.

11. The hydration system of claim 1 further comprising: an elbow connector attached to the end of tubing away from the user activated valve, the elbow connector including a male portion for engaging a portion of the check valve to cause the check valve to open when the elbow connector is attached to the outlet.

12. A method for hydrating a person comprising the steps of:

providing a first prefilled, flexible pouch having a potable liquid therein, the pouch having an outlet for passing liquid from the pouch and including a check valve;

providing a hydration tube having a first end and a second end;

removably coupling the hydration tube at the first end thereof to the pouch outlet, thereby opening the check valve and allowing the liquid to flow from the pouch through the hydration tube;

a threaded connector attached to an end of the hydration tube away from the user actuated valve; and a quick disconnect connector including flanges attached to the threaded connector; wherein the outlet includes seat openings for accommodating the flanges and the check valve includes a spring biased valve stem;

providing means for consuming the liquid through the second end of the hydration tube;

decoupling the first prefilled, flexible pouch from the hydration tube upon consumption of at least a portion of the liquid therefrom, the check valve precluding the liquid from flowing from the pouch upon decoupling;

providing subsequent prefilled, flexible pouches having a potable liquid therein, each pouch having an outlet for passing liquid from the pouch and including a check valve; and repeatedly coupling, consuming, and decoupling the subsequent pouches.

13. A hydration system comprising:

a prefilled, flexible pouch having fluid therein, the pouch having an outlet for passing fluid from the pouch and including a check valve;

a hydration tube having two ends and removably coupled at one end to an outlet of the pouch;

a user actuated valve connected at one end of the hydration tube distal from the outlet, wherein the check valve is open to allow fluid to flow from the flexible pouch when the hydration tube is coupled to the flexible pouch and the check valve is closed to prevent fluid from flowing from the flexible pouch when the hydration tube is decoupled from the flexible pouch, such that the pouch may be disconnected from the hydration tube without leakage;

a threaded connector attached to an end of the hydration tube away from the user actuated valve; and a quick disconnect connector including flanges attached to the threaded connector, wherein the outlet includes seat openings for accommodating the flanges and the check valve includes a spring biased valve stem.

* * * * *